US005790424A

United States Patent [19]

Sugihara et al.

[11] Patent Number: 5,790,424

[45] Date of Patent: Aug. 4, 1998

[54] PLANT MONITORING APPARATUS AND MONITORING METHOD

[75] Inventors: Masashi Sugihara, Ibaraki-ken; Masayuki Fukai, Hitachi; Takekazu Maruyama, Mito, all of Japan

[73] Assignee: Hitachi, Ltd., Tokyo, Japan

[21] Appl. No.: 502,298

[22] Filed: Jul. 13, 1995

[30] Foreign Application Priority Data

Jul. 25, 1994 [JP] Japan ..... 6-172273

[51] Int. Cl.[6] ..... G07C 3/00; G07C 3/02

[52] U.S. Cl. ..... 364/551.01; 340/679; 364/550; 377/16

[58] Field of Search ..... 340/679, 680; 364/550, 551.01, 138; 377/16

[56] References Cited

U.S. PATENT DOCUMENTS

| | | | |
|---|---|---|---|
| 2,883,255 | 4/1959 | Anderson | 364/551.01 X |
| 4,346,446 | 8/1982 | Erbstein et al. | 364/551.01 |
| 4,517,637 | 5/1985 | Cassell | 364/138 |
| 5,227,122 | 7/1993 | Scarola et al. | 376/259 |
| 5,262,944 | 11/1993 | Weisner et al. | 364/413.02 |
| 5,541,415 | 7/1996 | Shonka | 250/374 |

FOREIGN PATENT DOCUMENTS

| | | |
|---|---|---|
| 52-113134 | 9/1977 | Japan . |
| 60-144120 | 7/1985 | Japan . |
| 2-31246 | 2/1990 | Japan . |
| 2-188899 | 7/1990 | Japan . |

OTHER PUBLICATIONS

"Measuring Control and Automation IV. Control and Automation of Steam Power Plant", Jul. 1993, Heat/Nuclear Generation, pp. 79–104.

*Primary Examiner*—Edward R. Cosimano

*Attorney, Agent, or Firm*—Fay, Sharpe, Beall, Fagan, Minnich & McKee

[57] ABSTRACT

In a display method and a display unit, information which is required or often used by an operator is processed visually conspicuously by enlarged display or colored display in accordance with historical data such as the past running conditions of the plant, the number of times of operations by an operator, the frequency of operations, and so on, and the processed information is displayed on the display unit. The use of historical data permits an operator to readily recognize which equipment is in most need of attention due to repeated problems in the past.

19 Claims, 7 Drawing Sheets

PLANT MONITORING APPARATUS AND MONITORING METHOD

BACKGROUND OF THE INVENTION

The present invention relates to a plant monitoring apparatus and a monitoring method for monitoring and displaying running conditions, faults and so on of plant equipments on a display unit such as a CRT, a large screen, or the like, and particularly relates to a plant monitoring apparatus and a monitoring method preferable to improve the performance with which an operator monitors and operates the plant.

For example, as described in "Measuring Control and Automation IV. Control and Automation of Steam Power Plant" in the July 1993 issue of "Heat/Nuclear Power Generation", the process conditions of a plant and the running conditions of equipments have been monitored through a CRT screen of a computer, a CRT screen of a CRT operation system, or the like. Then, operating terminals for operating the plant equipments are displayed on the CRT display screen, so as to operate the plant equipments by touching the operating terminals.

As disclosed in JP-A 2-31246, there has also been a method in which a system diagram of a plant is displayed, and when an abnormality occurs in a plant equipment, a symbol corresponding to this plant equipment is colored, or the like, to inform an operator of the abnormality.

In the above-mentioned conventional arts, however, the whole information about a plant is merely equally displayed regardless of the importance, and the whole information displayed is not always necessary or important for an operator. Accordingly, the operator is brought into an excess of information, and information necessary and timely for the operator is not always provided.

In the above-mentioned prior arts, it is not taken into consideration that specially required information of process information corresponding to the running conditions of a plant or required by an operator is emphasized and displayed on a display unit, and displayed information includes information which is more than necessary and sufficient one, and which is not required very much. It is therefore necessary for the operator to select the information displayed on the display unit to obtain necessary information. Accordingly, the operator is loaded with a heavy burden. Therefore, there has been a problem that the operator feels mental pain in monitoring, and may misread or misjudge information because of the excess of information.

SUMMARY OF THE INVENTION

It is therefore an object of the present invention to solve the foregoing problems.

It is another object of the present invention to provide a suitable display unit for displaying running conditions of a plant and a suitable display method in which, of plant information displayed on a screen, information necessary for an operator can be clearly distinguished from unnecessary information to thereby improve the performance with which the operator monitors and operates the plant, and reduce the burden of the operator.

In order to attain the foregoing objects, according to an aspect of the present invention, in the plant running condition monitoring and displaying apparatus for displaying information about running conditions of a plurality of plant equipments together with symbols corresponding to the plant equipments so as to constitute a plant system diagram on a display screen, changes of the running conditions of each of the plant equipments are stored as historical data for all of the plant equipment, and displayed forms of the information about the running conditions and/or the symbols are sequentially changed so as to be displayed emphatically in accordance with the stored historical data.

Preferably in the case of displaying the above-mentioned plant running conditions by means of process quantities of a plurality of plant equipments, the numbers times of faults or abnormalities occurring in each of the plant equipments are stored as historical data for every the plant equipment, and displayed forms of the process quantities and/or the symbols are sequentially changed so as to be displayed emphatically in accordance with the stored historical data.

Further preferably in the case where the plant equipments are operated through a display screen, the number of times of operations of each of the plant equipments is stored as historical data for every the plant equipment, and displayed forms of the process quantities and/or the symbols are sequentially changed so as to be displayed emphatically in accordance with the stored historical data.

Further preferably in the case where an alarm is generated when an abnormality occurs in the plant equipments, the number of times of generation of the alarm for each of the plant equipments is stored as historical data, and displayed forms of the process quantities and/or the symbols are sequentially changed so as to be displayed emphatically in accordance with the stored historical data.

As for these changeable displayed forms of the process quantities and/or the symbols, one or a plurality of displayed shape, displayed size, and color may be selectively employed, or all of them may be employed. In addition to those means mentioned above, other marks may be appended near the symbols in accordance with the above-mentioned historical data.

According to another aspect of the present invention, in a plant running condition monitoring and displaying method for displaying process quantities of a plurality of plant equipments together with symbols corresponding to the plant equipments so as to constitute a plant system diagram on a display screen, the sizes of display of the process quantities and/or the symbols are made larger as the number times of occurrence of faults or abnormalities in the plant equipments increases.

Preferably, as parameters for enlarging the sizes of the displayed process quantities and/or symbols, the numbers of times of operations of the plant equipments may be used when the plant equipments are operated through the display screen, and the numbers of times of generation of alarms in the plant equipments may be used when an alarm is generated when an abnormality occurs in the plant equipments. It is a matter of course that any one of or a plurality of these parameters may be employed, or all of them may be employed.

Preferably, when the parameter exceeds a predetermined value, the size of display of the process quantity and/or the symbol corresponding to the faulty or abnormal plant equipment is made larger at least than that of the process quantity and/or the symbol before the number of times of occurrence of faults or abnormalities exceeds the predetermined value.

According to a further aspect of the present invention, the plant running condition monitoring and displaying apparatus comprises:

(a) a historical data base in which the number of times of operations of each of a plurality of plant equipments and/or the number of times of generation of an alarm generated when an abnormality occurs in each of the plant equipments are stored for every one the plant equipments;

(b) a historical data processing function for outputting display change quantities for changing predetermined displayed forms of symbols corresponding to the plant equipments and process quantities of the plant equipments on the basis of the number of times of operations and/or the number of times of generation of the alarm stored in the historical data base;

(c) a screen processing function for changing the displayed forms on the basis of the display change quantities outputted from the historical data processing function; and (d) a screen displaying function for displaying the displayed forms of the symbols and the process quantities changed by the screen processing function on a screen.

Preferably, the plant running condition monitoring and displaying apparatus further comprises, in addition to the above constituent features, means for returning the displayed forms of the symbol and the process quantity changed by the screen processing function to the predetermined displayed forms.

Further, in the plant running condition monitoring and displaying apparatus having operation terminal display screens provided for each of a plurality of plant equipments and for operating the plant equipments through a display picture screen, the numbers of times of operations of the plant equipments through the operation terminal display screens are stored for each of the plant equipments, and kinds of the operation terminal display screens to be displayed on the display picture screen are decided on the basis of the stored numbers of times of operations, so that the decided kinds of the operation terminal display screens are displayed on the display picture screen.

Preferably, the kinds of the operation terminal display screens are decided in the order that the stored numbers of operations decrease.

If the intervals of operations of the plant equipments through the operation terminal display screens are stored for each of the plant equipments, a predetermined number of the kinds of the operation terminal display screens may be decided in the order that the stored intervals of operations increase.

When operators monitor a plant, the operators need to particularly and selectively monitor plant equipments in which faults or abnormalities are apt to occur, and plant equipments in which delay is apt to occur in automatic operation, and the delay is often solved through manual operation. Therefore, these items can be necessary and important information when the plant is monitored.

The present invention is therefore intended to display such information necessary and important for operators by displaying symbols and/or process quantities of plant equipments in which faults or abnormalities often occur, and manual operation is often performed, so that these symbols and/or process quantities can be clearly distinguished from the other symbols and/or process quantities. Therefore, the number of times of occurrence of faults or abnormalities, and the number of times of manual operations are stored as historical data for each of the plant equipments, and the displayed forms of the symbols and/or the process quantities are changed on the basis of the historical data. The sizes of display of the symbols and/or the process quantities are made larger in accordance with the above-mentioned numbers of times, so that necessary information can be clearly and easily distinguished from unnecessary information displayed on the same display screen showing a plant system diagram. Accordingly, it is possible to reduce the burden of the operators.

In the same manner in operation terminal display screens for operating the plant equipments, the number of times of the operations performed through the operation terminal display screens is stored for each of the operation terminal display screens, and the kinds of the operation terminal display screens to be displayed on a display picture screen are decided in accordance with the number of times of the operations. Particularly, if a predetermined number of the operation terminal display screens are displayed in the order that the number of times of the operations decrease, especially necessary ones of the many operation terminal display screens can be displayed intensively. It is therefore easy to manage operation terminals, and it is possible to improve the performance of operations.

DESCRIPTION OF THE PREFERRED EMBODIMENTS

Figure 1:
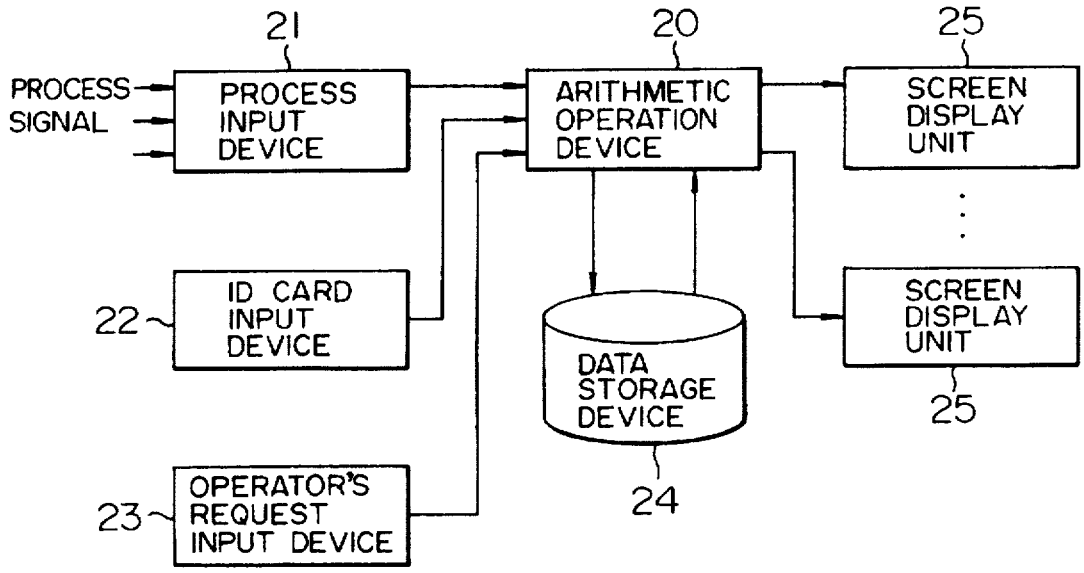
FIG. 1 is a diagram illustrating a hardware structure according to an embodiment of the present invention.

An embodiment of the present invention will be described below with reference to FIGS. 1 and 2. FIG. 1 is a diagram illustrating a hardware structure of a plant monitoring apparatus according to an embodiment of the present invention, FIG. 2 is a diagram illustrating the whole structure of a display unit for displaying the running conditions of a plant according to the embodiment, and FIG. 3 is a diagram illustrating a specific example of the screen display using the display unit for displaying the running conditions of a plant according to this embodiment shown in FIG. 2.

As shown in the hardware structure of FIG. 1, a plant monitoring apparatus in this embodiment is arranged as follows. That is, the plant monitoring apparatus has a process input device 21 which is a device for inputting process information 1 of a plant or an equipment system; an arithmetic operation device 20 which is a device connected to the process input device 21 and for performing processing, editing, and historical data processing (having functions 2, 4 and 5 in FIG. 2) which will be described later; an ID card input device 22 which is a device connected to the arithmetic operation device 20 and for identifying a display unit user, and taking charge of a function 7 shown in FIG. 2; an operator's request input device 23 which is a device connected to the arithmetic operation device 20 and for inputting requests of the display unit user, and taking charge of a function 8 shown in FIG. 2; a data storage device 24 which is a device connected to the arithmetic operation device 20 and for storing historical data, exchanging data therewith, and taking charge of a function 3 shown in FIG. 2; and a screen display unit 25 which is a device, such as a CRT (cathode ray tube display unit), a large indicator or the like, receiving electric signals from the arithmetic operation device 20 and for displaying a processed and edited screen, and taking charge of a function 6 shown in FIG. 2.

Figure 2:
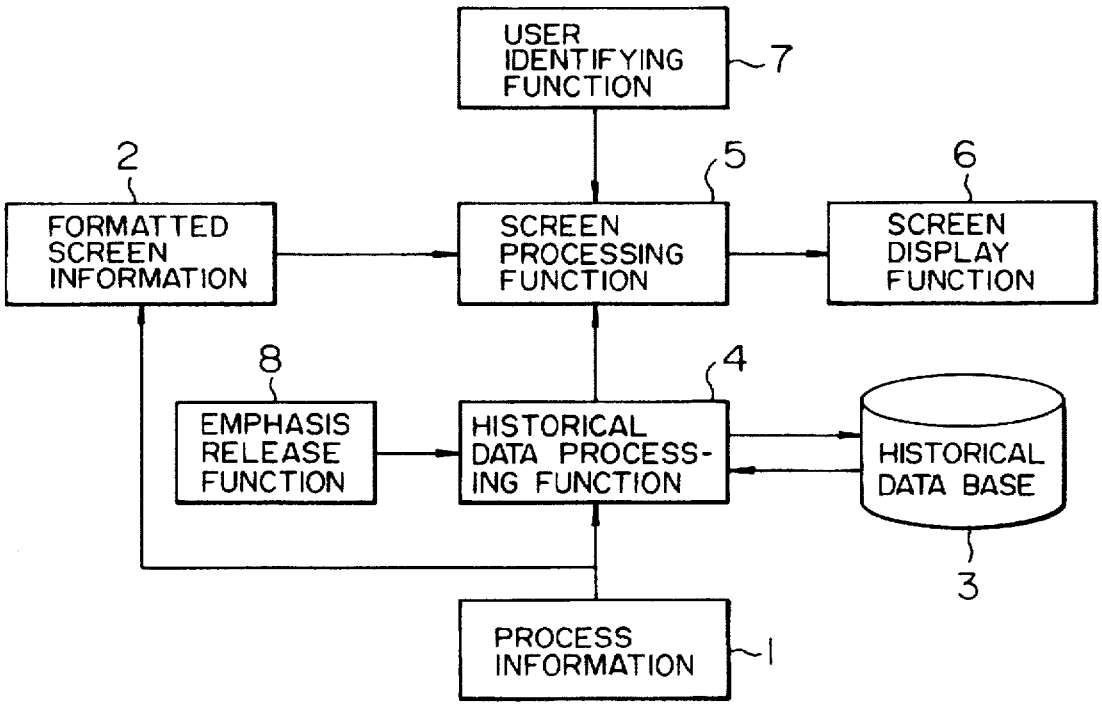
FIG. 2 is a diagram illustrating the whole structure of a display unit for displaying the running conditions of a plant according to the embodiment.
Figure 3:
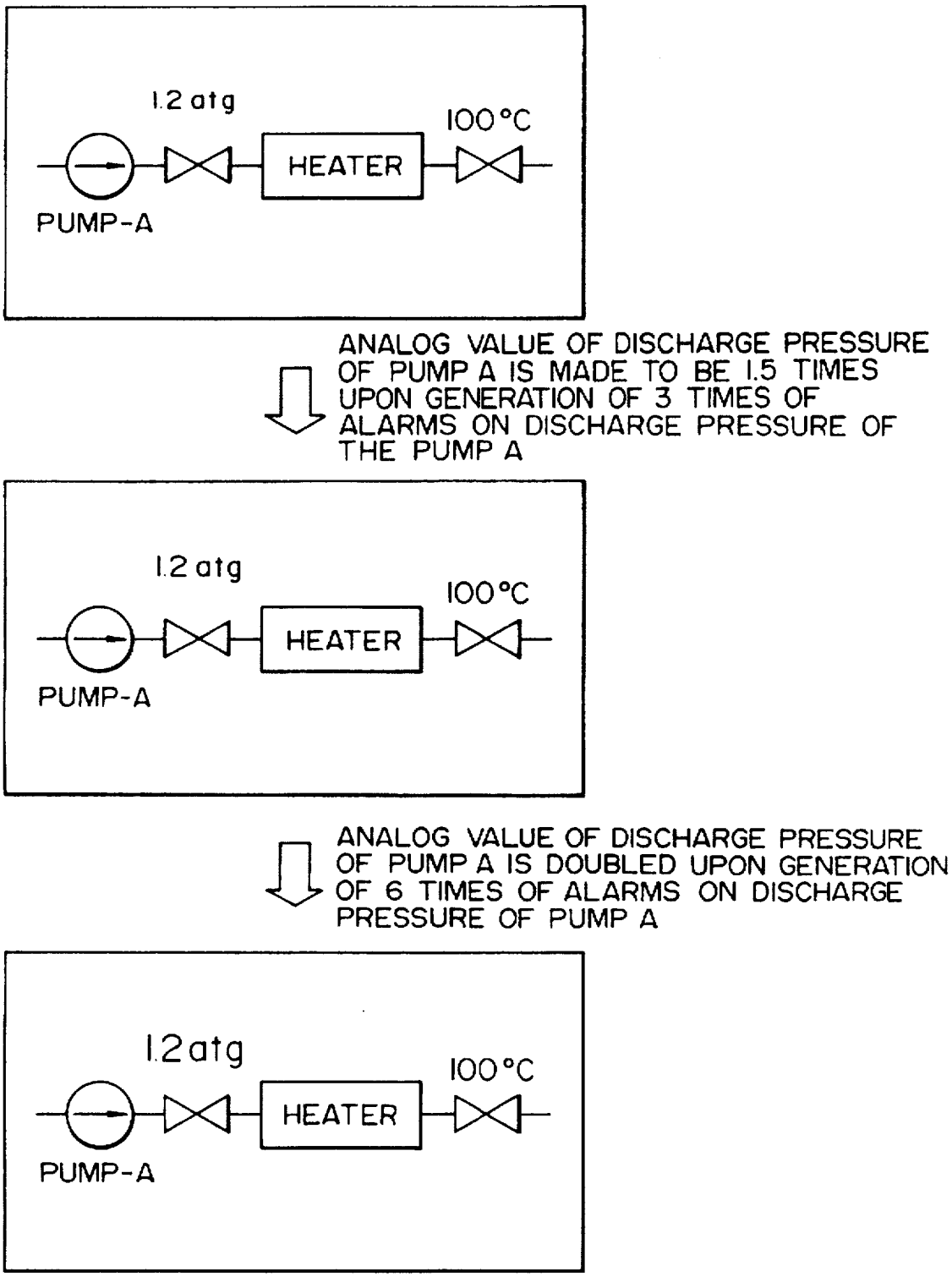
FIG. 3 is a diagram illustrating a specific example of screen display using the display unit for displaying the running conditions of a plant shown in FIG. 1.

Functions (processing) of the plant monitoring apparatus arranged thus are shown in FIG. 2. The process information 1, such as temperature, pressure, flow, or running conditions of equipments, put from the process input device 21 is read into formatted screen information 2 which is prepared in advance. In connection with each of plant equipments, the time, number or the like of faults or abnormalities, or given alarms is arithmetically processed and recorded in the data storage device 24 as a historical data base 3. A historical data processing function 4 judges and processes the degree of emphasis of process information to be displayed on the formatted screen information 2 in accordance with the number or frequency of given alarms on the basis of the data of the historical data base 3. The process information in the formatted screen information 2 is emphasized by a screen processing function 5, and this result is displayed on the screen display unit 25 by a screen display function 6. Further, a function to identify a display unit user is provided in the ID input device 22 by use of an ID card or the like, so that the content displayed on the screen can be changed in accordance with the user. In addition, an emphasis release function 8 to release emphasized display and return the display to its original state in a certain period or in accordance with an operator's request may be added when the display is emphasized by the historical data.

Although the quantities of process states as well as a system and equipments of a plant are conventionally displayed on a system diagram of a CRT screen, in this embodiment, the number of times faults, abnormalities etc., the number of times, the date, the frequency etc., of generation of alarms, and so on are counted as historical data for every plant equipment, and display is carries out while changing the displayed forms of the symbol and/or the process quantity corresponding to the plant equipment in accordance with the counted number of times, the frequency, and so on. For example, if the number of times of given alarms is n, the size of the display of the corresponding process quantity is made 1.5 times and 2.0 times as large as those of other process quantities when n=3 and when n=6 respectively. Accordingly, necessary information can be displayed more emphatically than any other information by making the size of the display of the process quantity larger than the other process quantities. FIG. 3 shows that the display of process quantity of discharge pressure of a pump A is doubled because of six times of alarms given upon the discharge pressure of the pump A. Although the method of increasing the size of the display of process quantity displayed on the screen is herein adopted as the method of emphasizing the display, there are also a method of changing the color of process quantity from light one to heavy one, a method of emboldening the figures of a process value, a method of affixing a mark (such as "!") around process quantity, and so on. The displayed form (color, size or the like) of a symbol itself may be changed. Only one of, a plurality of, or all of these methods of changing displayed forms may be adopted.

When the screen is displayed, not only the process quantity is displayed emphatically in accordance with historical data, but also the historical data itself such as the date, the number of times, or the like, of alarms given in the past can be displayed by use of a multi-window function or the like.

In another example, there is a case where the trend of the process quantity is displayed on another screen to thereby monitor the running of a plant. In this case, information which has often been designated for displaying its trend is so important as to be selected from a large number of process quantities, and this number of times of designation is recorded as historical data. On the basis thereof, it is possible to emphasize the corresponding process quantity in a graphic system diagram in the above-mentioned manner. By displaying a more important process emphatically thus, it is possible to reduce the possibility of misreading.

In the prior art, when there occurs abnormality in process conditions or equipments in a plant, an alarm is displayed on an alarm window of a control panel, or abnormal items are displayed on a CRT screen. In such a manner, the abnormality cannot be recognized until the alarm is given. However, with a process monitoring apparatus according to the embodiment, the process quantity which is comparatively high in the frequency of given alarms is displayed emphatically. Accordingly, it is possible to detect abnormality early, and reduce the possibility of misreading or the like of information.

Figure 4:
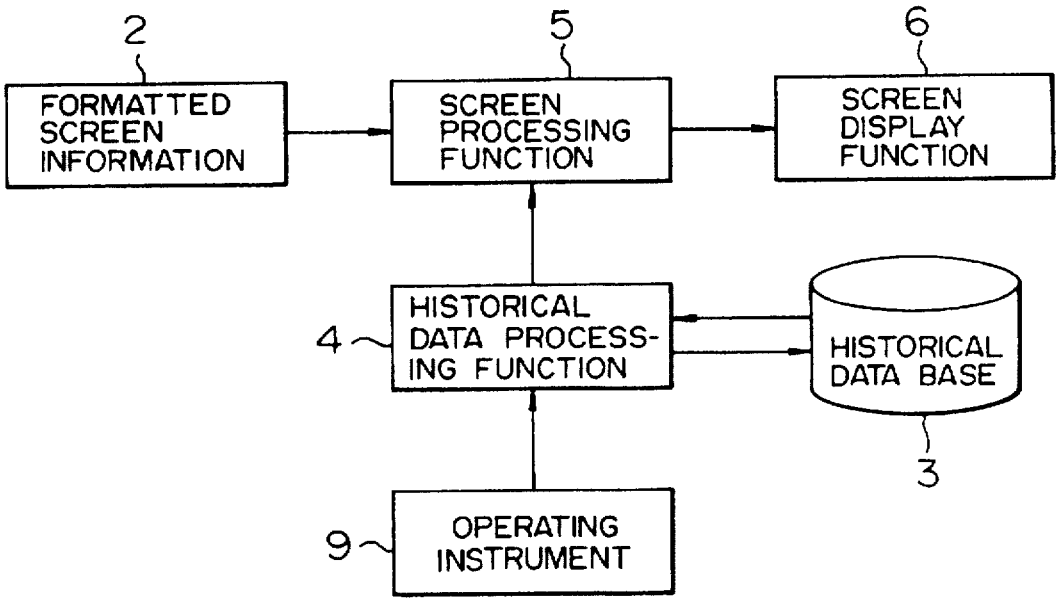
FIG. 4 is a diagram illustrating the whole structure of a display unit for displaying the running conditions of a plant according to another embodiment of the present invention.
Figure 5:
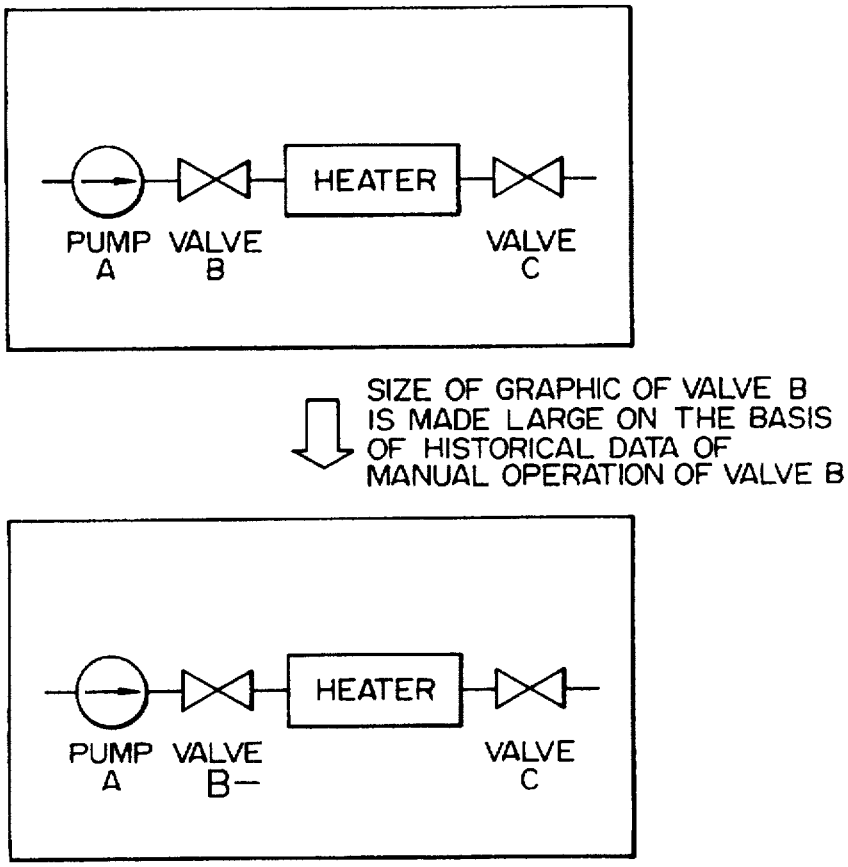
FIG. 5 is a diagram illustrating a specific example of screen display using the display unit for displaying the running conditions of a plant shown in FIG. 4.

Next, another embodiment of the present invention will be described with reference to FIGS. 4 and 5. FIG. 4 is a diagram illustrating the whole structure of a display unit for displaying the running conditions of a plant according to this embodiment; and FIG. 5 is a diagram illustrating a specific example of screen display using the display unit for displaying the running conditions of the plant according to this embodiment described in FIG. 4.

This embodiment also has a hardware structure similar to that shown in FIG. 1. In this embodiment, the date, the number of times, the frequency, etc., of manual operations of each operating terminal (operating instrument 9) are recorded in a historical data base 3 as historical data for every operating terminal. A historical data processing function 4 judges and processes the degree of emphasis of corresponding equipment information to be displayed on a formatted screen information 2 in accordance with the number of times, the frequency, etc., of operations of the operation terminal on the basis of the data of the historical data base 3. The equipment information in the formatted screen information 2 is emphasized by a screen processing function 5, and this result is displayed on a display unit by a screen display function 6.

The operating terminal designated by a symbol corresponding to a plant equipment is indicated, and the date, the number of times, the frequency, etc., of manual operations of this plant equipment are counted as historical data. Then, the displayed size of the operating terminal is changed in accordance with the counted number of times or frequency of the manual operations, so as to display the operating terminal emphatically.

This means for changing the size of display of an operating terminal designated by a symbol is the same as what was described in FIGS. 2 and 3. The size is enlarged in accordance with the number of times of manual operations. In addition, by use of a plurality of predetermined values (for example, the number of times of operations is 3, 6, . . . , or the like), the size of the symbol may be increased sequentially whenever the number of times of manual operations exceeds one of these predetermined values. In this case, not only the size of the symbol but also the tone or the like may be changed. Although only one of these changes of displayed forms may be adopted, a plurality or all of them may be adopted.

In a heat power plant, starting and stopping are performed almost automatically by a computer, a sequence control apparatus and so on. Therefore, of several hundred of operating terminals, the number of times of operating terminals operated by operators individually is very small, and such a chance is rare. That is, the chance of operation is given only at limited opportunities such as the operation of compensating the deterioration of a process state, and returning the state to a original normal value of the like, the operation of recovering a normal state when automation is delayed, and so on. Therefore, there is usually few chance of operation, and if some trouble occurs once, a mental burden of the operator is so large that there is a possibility that the operator may make an error in operation. Accordingly, it is effective to display and emphasize an operating terminal which is high in the frequency of operations (meaning a frequent intervention of manual operation) so as to call operator's attention. As a result, it is possible to make a large contribution to the prevention of erroneous operating, and the prevention of misreading.

Figure 6:
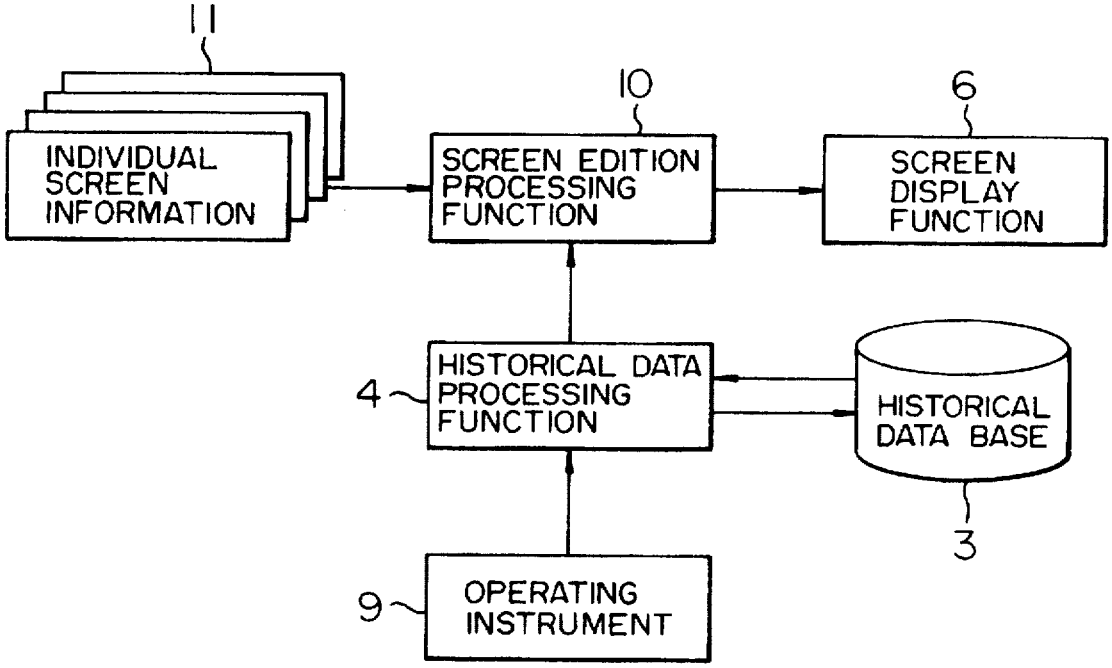
FIG. 6 is a diagram illustrating the whole structure of a display unit for displaying the running conditions of a plant according to another embodiment of the present invention.

Next, another embodiment of the present invention will be described with reference to FIGS. 6 and 7. FIG. 6 is a diagram illustrating the whole structure of a display unit for displaying the running conditions of a plant according to this embodiment; and FIG. 7 is a diagram illustrating a specific example of screen display using the display unit for displaying the running conditions of a plant according to this embodiment described in FIG. 6.

Figure 7:
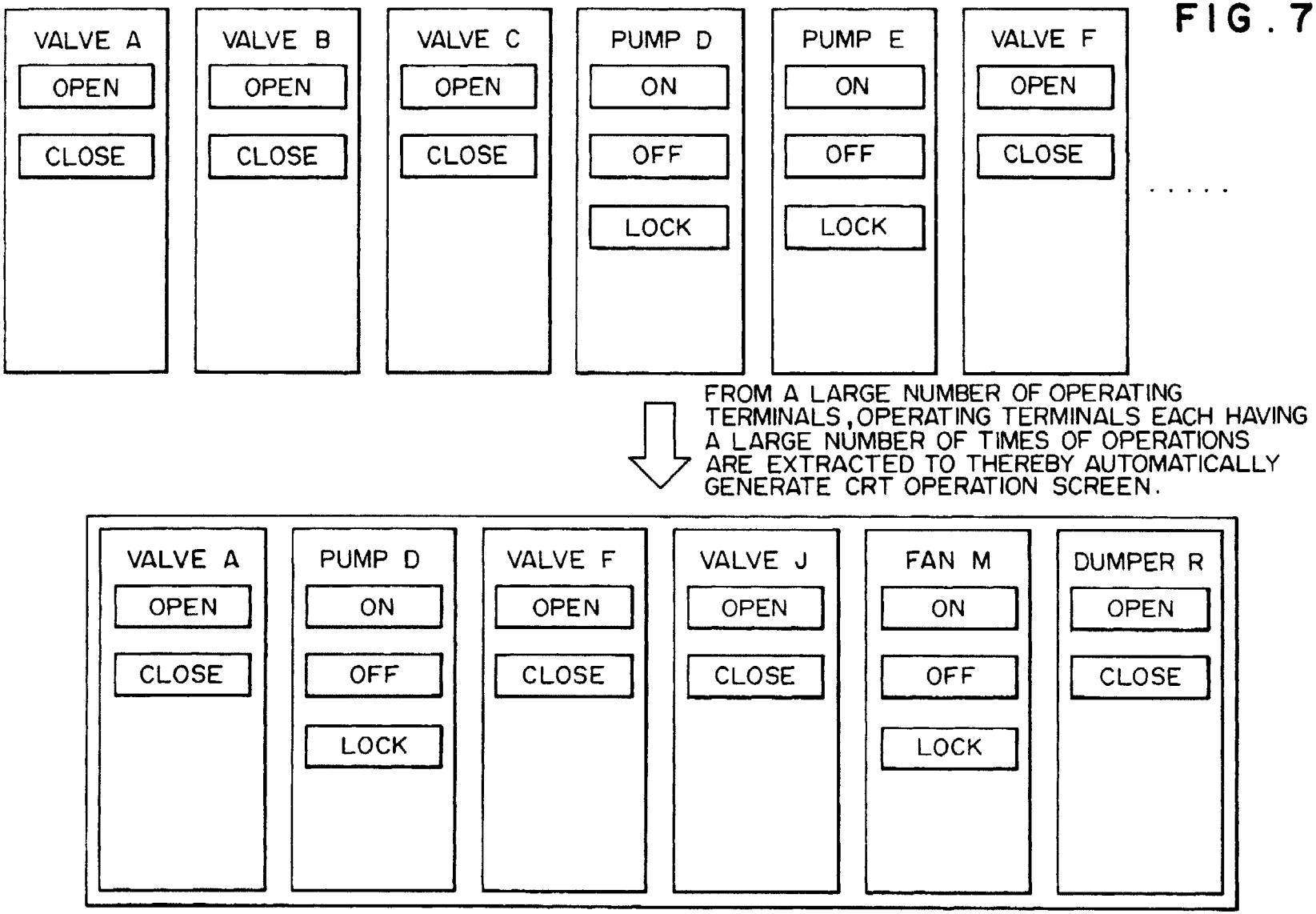
FIG. 7 is a diagram illustrating a specific example of screen display using the display unit for displaying the running conditions of a plant shown in FIG. 6.

By use of a display screen of operating terminals as shown in FIG. 7, the date, the number of times, the frequency, etc., of manual operations of each plant equipment is recorded in a historical data base 3 as historical data for every operating terminal. A historical data processing function 4 selects and processes a necessary operating terminal in accordance with the number of times, the frequency, etc., of operations of the operation terminal on the basis of the data of the historical data base 3. The operating terminal selected by the historical data processing function 4 is edited by the screen edition processing function 10 as a sheet (or a plurality of sheets if it cannot be edited into one sheet) for CRT operation screen on the basis of individual screen information 11 which is display information about the respective operating terminals. When this edited screen is selected, for example, if a key named "Operation Frequency Large" is provided in a selection menu, so as to select this key and display the screen, it is possible to select a target operating terminal easily. Further, the screen can be edited in the combination of plant conditions and historical data such as "Starting Process", "Stopping Process", "Trouble Occurrence" and so on, so that it is possible to obtain a screen which is high in the performance of operation.

In a CRT operation apparatus for performing an adjustment control station operation, a valve open/close establishment operation, and an equipment on/off operation through a CRT display screen and operation keys, the date, the number of times, the frequency, etc., of operations of each operating terminal is recorded as historical data every operating terminal. Then, operating terminals are selected by the historical data, for example, in the order that the number of times of operations decreases, or in the order that the date of operations increases, or the like, and a CRT operation screen corresponding to the selected operating terminals is produced automatically.

The function of the above-mentioned apparatus will be described in detail. As shown in FIG. 7, there are a large number of operating terminal display screens for manual operation of plant equipments, and the respective numbers of times of operations in these operating terminal display screens are stored as historical data respectively. A predetermined number (for example, six) of the operating terminal display screens are selected in the order that the numbers of times of operations stored in this historical data are decreased, so as to arrange a CRT operation screen for displaying the selected operating terminal display screens. In FIG. 7, six operating terminals from an operating terminal for a valve A to an operating terminal of a dumper R are selected because they have larger numbers of times of operations, so as to constitute a CRT operation screen. Those with larger number of times of operations may be arranged sequentially in the order from the left end of the screen. In addition, the number of the operating terminal display screens constituting a CRT operation screen, the order of the arrangement, and so on, are not always limited in those shown in FIG. 7, and they may be set freely at designer's will.

While there are several hundred of operating terminals in a heat power plant, only about eight operating terminals are displayed in one screen of conventional CRT operation. Therefore, the number of sheets of the screens has been enormous in the conventional case. On the other hand, in a plant where automation is realized by a computer, a sequence control apparatus and so on, starting and stopping are performed almost automatically. Therefore, the number of operating terminals operated individually by operators is very small, and such a chance is rare. It may be therefore, considered that operating terminals having a large number of times of operations are specified in advance, and collected on a screen. However, this idea cannot be realized since the items in need of manual intervention are different between individual plants. In this embodiment, items high in the frequency of operations can be collected to form an operation screen, and it is also possible to release operators from such a trouble that necessary operating terminals are selected from a large number of operating terminals.

Figure 8:
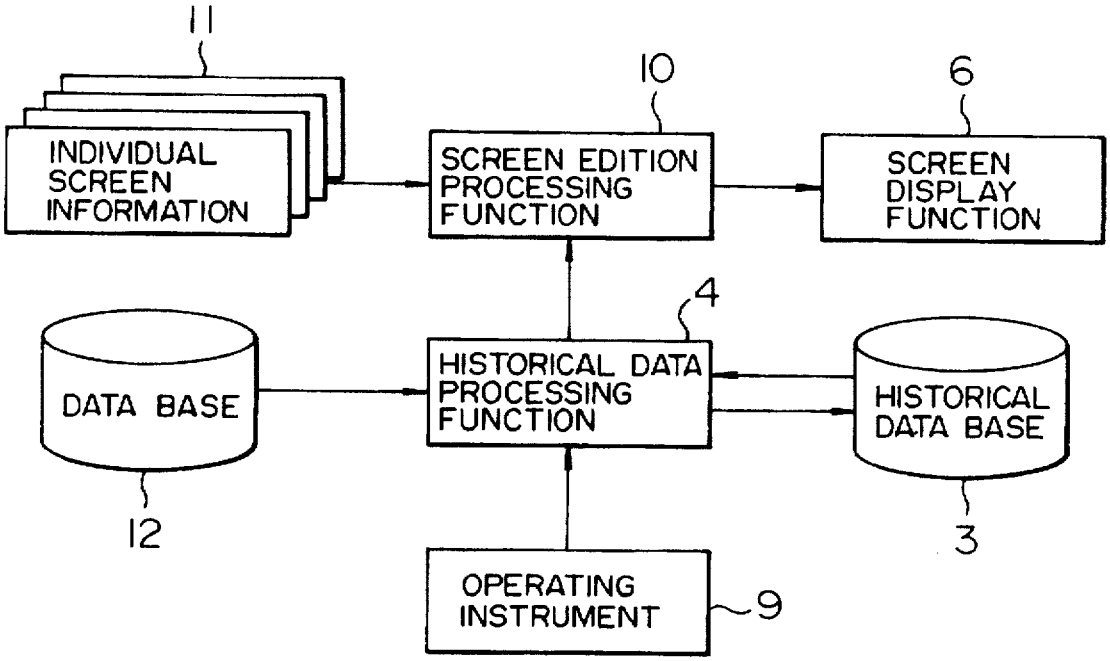
FIG. 8 is a diagram illustrating the whole structure of a display unit for displaying the running conditions of a plant according to another embodiment of the present invention.
Figure 9:
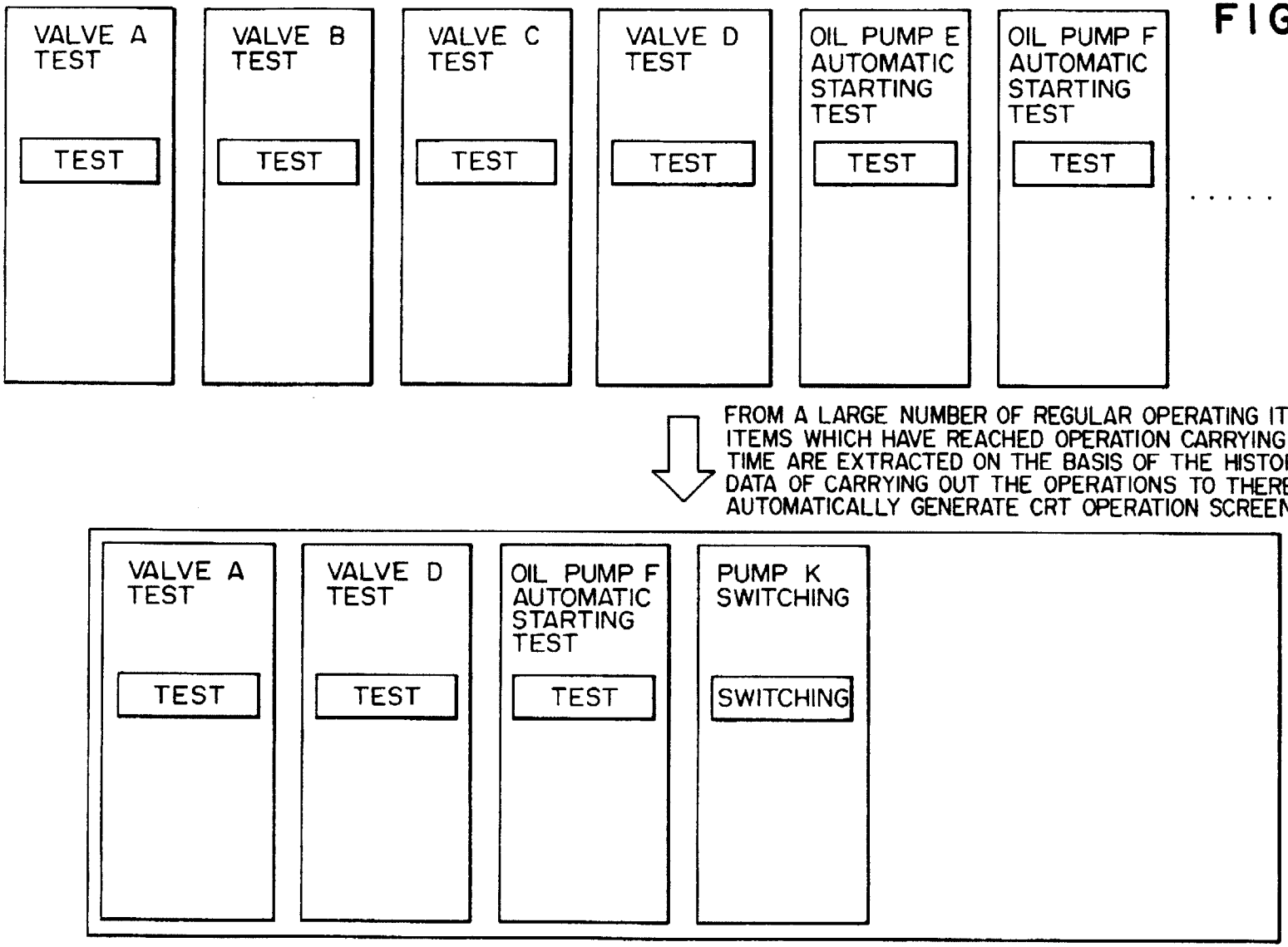
FIG. 9 is a diagram illustrating a specific example of screen display using the display unit for displaying the running conditions of a plant shown in FIG. 8.

Next, another embodiment of the present invention will be described with reference to FIGS. 8 and 9. FIG. 8 is a diagram illustrating the whole structure of a display unit for displaying the running conditions of a plant according to another embodiment of the present invention; and FIG. 9 is a diagram illustrating a specific example of the screen display using the display unit for displaying the running conditions of a plant according to this embodiment described in FIG. 8.

In the plant monitoring apparatus according to this embodiment, the dates in which operating terminals set in regular operation items were operated are recorded in a historical data base 3 as historical data. In addition, the frequencies of operations of the respective regular operation items are recorded in a data base 12 in advance. In a historical data processing 4, the data of the historical data base 3 is compared with the data of the data base 12, and it is judged whether the operation items reach their operation time or not so as to select operation items which have reached the operation time. Operating terminals corresponding to the operation items selected by the historical data processing 4 are edited by a scene edition processing function 10 as one sheet (or a plurality of sheets if it cannot be edited into one sheet) of CRT operation screen on the basis of individual screen information 11. When this edited screen is selected, for example, if a key named "Regular Operation Item" is provided in a selection menu so as to select this key and display the screen, it is possible to select a target operating terminal easily.

In the regular operation items such as oil pump automatically starting test, valve test, pump switching, and so on, the date and frequency of operations are recorded as historical data, and the frequency (for example, once a week, once a month, or the like) defined for every regular operation item is compared with a period after the previous operation, so that a CRT operation screen is automatically constituted by operating terminals corresponding to operation items which has reached their operation time.

Since the number of regular operations is very large in some plants, and operations are different in frequency from each other, it has not been easy to manage the time of operation. According to this embodiment, regular operation items are collected on one screen, so that not only it is possible to improve the performance of operation, but also it is possible to manage the operation time of the regular operation items.

As another example, the time to perform regular operation items or periodical inspection items such as confirmation of oil surface, greasing up, and so on, are recorded in advance. When it reaches the time of carrying out the operation, an operating terminal in a graphic system diagram corresponding hereto may be displayed emphatically as described above. In this case, it is possible to manage the regular operation or periodical inspection items easily.

Figure 10:
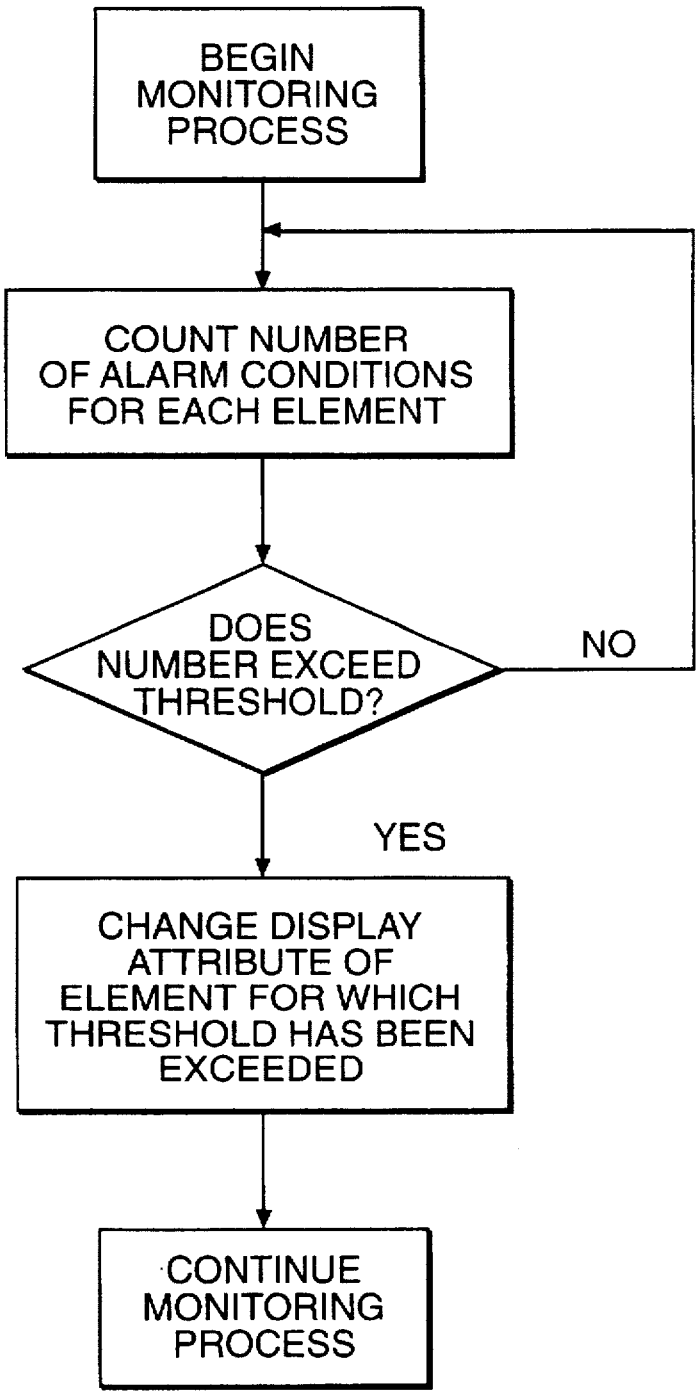
FIG. 10 is a flowchart of an overall process of the plant according to the present invention.

According to the present invention, information necessary for an operator can be displayed and clearly distinguished from unnecessary information, so that it is possible for the operator to grasp actually necessary information precisely. Accordingly, there is no mental pain caused by the excess of information, and there is no case where displayed information is misread or misjudged so as to give a large trouble to the running of a plant. A flow chart of an overall process of the plant according to the present invention is shown in FIG. 10. In addition, necessary operating terminals are selected for the operation, so that it is possible to release the operator from such a trouble that actually necessary operating terminals are selected from a large number of operating terminals. Accordingly there is an effect that it is possible to realize safe and allowable running monitoring and operation.

What is claimed is:

1. A plant monitoring apparatus for displaying information about running conditions of a plurality of plant equipments together with symbols corresponding to said plant equipments so as to constitute a plant system diagram on a display screen, comprising:

a historical data base; and a processor, wherein changes of said running conditions of each of said plant equipments are stored into said historical data base as historical data, and displayed forms of said information about said running conditions and/or said symbols are sequentially changed by said processor so as to be displayed emphatically in accordance with said stored historical data.

2. A plant monitoring apparatus according to claim 1, further comprising means for identifying users of display units, and for displaying information on said respective display units in accordance with said respective users.

3. A plant monitoring apparatus for displaying process quantities of a plurality of plant equipments together with symbols corresponding to said plant equipments so as to constitute a plant system diagram on a display screen, comprising:

a historical data base; and a processor, wherein the number of times of faults or abnormalities occurring in each of said plant equipments are stored into said historical data base as historical data, and displayed forms of said process quantities and/or said symbols are sequentially changed by said processor so as to be displayed emphatically in accordance with said stored historical data.

4. A plant monitoring apparatus according to claim 3, wherein sizes of display of said process quantities and/or said symbols are made larger as the number of times of occurrence of faults or abnormalities in said plant equipments increases respectively.

5. A plant monitoring apparatus according to claim 3, wherein when the number of times of occurrence of faults or abnormalities in each of said plant equipments exceeds a predetermined value, the size of display of the process quantity and/or the symbol corresponding to the faulty or abnormal plant equipment is made larger at least than that of the process quantity and/or the symbol before said number of times of occurrence of faults or abnormalities exceeds said predetermined value.

6. A plant monitoring apparatus according to claim 3, further comprising means for identifying users of display units, and for displaying information on said respective display units in accordance with said respective users.

7. A plant monitoring apparatus for displaying process quantities of a plurality of plant equipments together with symbols corresponding to said plant equipments so as to constitute a plant system diagram on a display screen, said plant equipments being arranged so as to be operated through said display screen, comprising:

a historical data base; and a processor, wherein the number of times of operations of each of said plant equipments is stored into said historical data base as historical data, and displayed forms of said process quantities and/or said symbols are sequentially changed by said processor so as to be displayed emphatically in accordance with said stored historical data.

8. A plant monitoring apparatus according to claim 7, wherein sizes of display of said process quantities and/or said symbols are made larger as the number of times of operations of said plant equipments increases respectively.

9. A plant monitoring apparatus according to claim 7, wherein when the number of times of operations of each of said plant equipments exceeds a predetermined value, the size of display of the process quantity and/or the symbol corresponding to the concerned plant equipment is made larger at least than that of the process quantity and/or the symbol before said number of times of operations of the concerned plant equipment exceeds said predetermined value.

10. A plant monitoring apparatus according to claim 7, further comprising means for identifying users of display units, and for displaying information on said respective display units in accordance with said respective users.

11. A plant monitoring apparatus for displaying process quantities of a plurality of plant equipments together with symbols corresponding to said plant equipments so as to constitute a plant system diagram on a display screen, and for generating an alarm when an abnormality occurs in said plant equipments, comprising:

a historical data base; and a processor, wherein the number of times of generation of said alarm for each of said plant equipments is stored into said historical data base as historical data, and displayed forms of said process quantities and/or said symbols are sequentially changed by said processor so as to be displayed emphatically in accordance with said stored historical data.

12. A plant monitoring apparatus according to claim 11, wherein sizes of display of said process quantities and/or said symbols are made larger as the number of times of occurrence of said alarm for said plant equipments increases respectively.

13. A plant monitoring apparatus according to claim 11, wherein when the number of times of occurrence of the alarm in each of said plant equipments exceeds a predetermined value, the size of display of the process quantity and/or the symbol corresponding to the faulty or abnormal plant equipment is made larger at least than that of the process quantity and/or the symbol before said number of times of occurrence of the alarm exceeds said predetermined value.

14. A plant monitoring apparatus according to claim 11, further comprising means for identifying users of display units, and for displaying information on said respective display units in accordance with said respective users.

15. A plant monitoring apparatus comprising:

(a) a historical data base in which the number of times of operations of each of a plurality of plant equipments and/or the number of times of generation of an alarm generated when an abnormality occurs in each of said plant equipments are stored for every said plant equipment;

(b) a historical data processing function for outputting display change quantities for changing predetermined displayed forms of symbols corresponding to said plant equipments and process quantities of said plant equipments on the basis of said number of times of operations and/or said number of times of generation of the alarm stored in said historical data base;

(c) a screen processing function for changing said displayed forms on the basis of said display change quantities outputted from said historical data processing function; and (d) a screen displaying function for displaying said displayed forms of said symbols and said process quantities changed by said screen processing function on a screen.

16. A plant monitoring apparatus according to claim 15, further comprising:

(e) means for returning said displayed forms of said symbol and said process quantity changed by said screen processing function to said predetermined displayed forms.

17. A plant monitoring apparatus comprising:

operation terminal display screens provided for each of a plurality of plant equipments and for operating said plant equipments through a display picture screen, wherein the numbers of times of operations of said plant equipments through said operation terminal display screens are stored for each of said plant equipments, and kinds of said operation terminal display screens to be displayed on said display picture screen are decided on the basis of said stored numbers of times of operations, so that the decided kinds of said operation terminal display screens are displayed on said display picture screen.

18. A plant monitoring apparatus according to claim 17, wherein a predetermined number of kinds of said operation terminal display screens to be displayed on said display picture screen are decided in the order that said stored numbers of times of operations decrease, so that the decided kinds of said operation terminal display screens are displayed on said display picture screen.

19. A plant monitoring apparatus according to claim 17, wherein the intervals of operations of said plant equipments through said operation terminal display screens are stored for each of said plant equipments, and a predetermined number of kinds of said operation terminal display screens to be displayed on said display picture screen are decided in the order that said stored intervals of operations increase, so that the decided kinds of said operation terminal display screens are displayed on said display picture screen.

* * * * *